US010384849B2

(12) United States Patent
McKenna

(10) Patent No.: US 10,384,849 B2
(45) Date of Patent: Aug. 20, 2019

(54) SYSTEM AND METHOD FOR CONTAINING AND DISPENSING A LIQUID

(71) Applicant: AQUEDUCT INVEST LTD., Dublin (IE)

(72) Inventor: Kieran McKenna, Dublin (IE)

(73) Assignee: Aqueduct Invest Ltd., Dublin (IE)

( * ) Notice: Subject to any disclaimer, the term of this patent is extended or adjusted under 35 U.S.C. 154(b) by 0 days.

(21) Appl. No.: 14/935,531

(22) Filed: Nov. 9, 2015

(65) Prior Publication Data

US 2016/0060012 A1 Mar. 3, 2016

Related U.S. Application Data

(63) Continuation of application No. 12/741,843, filed as application No. PCT/EP2008/065180 on Nov. 7, 2008, now abandoned.

(30) Foreign Application Priority Data

Nov. 7, 2007 (IE) ..... S2007/0805

(51) Int. Cl.
*B65D 77/06* (2006.01)
*B67D 3/00* (2006.01)
(Continued)

(52) U.S. Cl.
CPC ..... *B65D 77/065* (2013.01); *B65D 77/30* (2013.01); *B65D 81/18* (2013.01); *B67D 1/0004* (2013.01); *B67D 1/0801* (2013.01); *B67D 1/0857* (2013.01); *B67D 3/0009* (2013.01); *B67D 3/0029* (2013.01); *F25D 31/006* (2013.01); *B67D 2001/0827* (2013.01); *F25D 2331/804* (2013.01); *F25D 2331/806* (2013.01)

(58) Field of Classification Search
CPC ..... B67D 1/0057; B67D 2210/00036; B67D 1/0021; B67D 1/0857; B67D 2001/0827; B67D 1/0009; B67D 1/00
USPC ..... 222/131, 183, 185.1
See application file for complete search history.

(56) References Cited

U.S. PATENT DOCUMENTS 2,574,931 A * 11/1951 Nason, Jr. ..... B65D 77/06 206/524.5
2,831,610 A * 4/1958 Dennie ..... B65D 5/5059 222/105

(Continued)

FOREIGN PATENT DOCUMENTS

EP 1520836 A1 * 4/2005 ..... B65D 77/067

*Primary Examiner* — Patrick M. Buechner
*Assistant Examiner* — Michael J. Melaragno
(74) *Attorney, Agent, or Firm* — Leason Ellis LLP

(57) ABSTRACT

The present invention provides a system for use in dispensing a liquid comprising a container, for example a box (1), for housing a flexible bag (5), the flexible bag having a bag wall with an interior surface for storing the liquid. A spout (6) disposed through the bag wall for dispensing liquid from the bag. The container comprises a tear-off portion (4) positioned near the base of the container to provide an opening (7) to allow the spout project from the container, and allow the bag to be substantially pulled out of the container, so that the spout projects substantially under the base level of said container in use. In a further embodiment there is provided a refrigerated housing for the inventive container for dispensing a liquid.

10 Claims, 11 Drawing Sheets

(51) Int. Cl.

| | |
|---|---|
| ***F25D 31/00*** | (2006.01) |
| ***B65D 77/30*** | (2006.01) |
| ***B65D 81/18*** | (2006.01) |
| ***B67D 1/00*** | (2006.01) |
| ***B67D 1/08*** | (2006.01) |

(56) References Cited

U.S. PATENT DOCUMENTS 2,954,901 A * 10/1960 Winstead ..... B65D 5/70 222/183
3,112,047 A * 11/1963 Weinreich ..... B65D 77/065 222/105
3,117,695 A * 1/1964 Cox, Jr. ..... B65D 75/5872 222/105
3,123,254 A * 3/1964 Rabby ..... B65D 77/065 222/105
3,138,293 A * 6/1964 Roak ..... B65D 75/5816 222/105
3,173,579 A * 3/1965 Curie ..... B65D 47/283 222/105
3,178,063 A * 4/1965 Cox, Jr. ..... B65B 3/045 222/105
3,178,064 A * 4/1965 Layne ..... B65D 5/701 222/105
3,199,742 A * 8/1965 Hill ..... B65D 77/065 222/183
3,204,825 A * 9/1965 Underwood ..... B65D 31/02 222/105
3,223,117 A * 12/1965 Curie ..... B65D 47/283 137/556.6
3,240,416 A * 3/1966 Deegan ..... B65D 77/064 229/117.3
3,325,058 A * 6/1967 West, Jr. ..... A47J 31/50 219/433
3,371,824 A * 3/1968 Goss ..... B65D 77/06 222/105
3,638,834 A * 2/1972 Goodrich ..... B65D 37/00 220/592.18
4,673,125 A * 6/1987 Weaver ..... B65D 5/724 222/105
4,690,307 A * 9/1987 Hogan ..... A23G 9/22 222/105
4,907,723 A * 3/1990 Katz ..... B67D 3/00 222/105
4,927,042 A * 5/1990 Ring ..... B65D 77/062 206/431
5,042,682 A * 8/1991 Ritter ..... B65D 77/062 222/185.1
5,344,048 A * 9/1994 Bonerb ..... B65B 69/0075 222/105
5,598,952 A * 2/1997 Daansen ..... A47K 5/12 222/105
5,975,642 A * 11/1999 Dibble ..... B60P 1/60 220/1.5
6,095,372 A * 8/2000 Dorsey ..... B67D 3/0009 222/105
6,186,361 B1 * 2/2001 Teetsel, III ..... B67B 7/26 222/1
6,209,756 B1 * 4/2001 Van Der Heijden ..... B65D 75/5883 222/105
6,223,944 B1 * 5/2001 Gehl ..... B65D 77/06 222/1
6,223,981 B1 * 5/2001 Gunder ..... B65D 5/5405 229/117.3
6,293,432 B1 * 9/2001 Hartwall ..... B65D 77/061 141/10
6,318,594 B1 * 11/2001 Hutchins ..... B65B 69/0091 222/1
6,347,718 B1 * 2/2002 Karpisek ..... B65D 77/061 206/600
6,497,343 B1 * 12/2002 Teetsel, III ..... B67B 7/26 222/1
6,561,386 B1 * 5/2003 Martens ..... B65D 77/067 222/105
6,827,237 B2 * 12/2004 Yorn ..... B65D 77/062 222/105
7,021,496 B2 * 4/2006 Almond ..... B67D 3/0009 222/105
7,076,966 B2 * 7/2006 Mullen ..... B67D 3/0009 222/132
7,975,879 B2 * 7/2011 Groesbeck ..... B65D 5/4204 220/4.01
8,459,503 B2 * 6/2013 Groesbeck ..... B65D 5/4204 220/592.01
2003/0155372 A1 * 8/2003 Yorn ..... B65D 77/062 222/105
2006/0112717 A1 * 6/2006 Walton ..... B65D 77/062 62/371
2006/0144857 A1 * 7/2006 Last ..... B67D 3/0012 222/105
2007/0131711 A1 * 6/2007 Minard ..... B65D 21/0223 222/105
2008/0277417 A1 * 11/2008 Groesbeck ..... B65D 5/4204 222/105
2010/0327027 A1 * 12/2010 Kasai ..... B65D 75/5866 222/105
2011/0036864 A1 * 2/2011 McKenna ..... B65D 77/065 222/105
2012/0152976 A1 * 6/2012 Yoshida ..... B41J 2/17513 222/81
2012/0318824 A1 * 12/2012 McKenna ..... B65D 77/067 222/185.1
2014/0076927 A1 * 3/2014 Brooks ..... B65D 77/067 222/105
2014/0083340 A1 * 3/2014 Dull ..... A01C 23/008 111/120

* cited by examiner

SYSTEM AND METHOD FOR CONTAINING AND DISPENSING A LIQUID

FIELD OF THE INVENTION

This invention relates generally to a system and method for containing and dispensing liquid. More specifically this invention is directed to an improved bag-in-box system for dispensing liquid.

BACKGROUND TO THE INVENTION

In the field of beverage and liquid systems an apparatus, commonly known as a bag-in-box package, is used to store and dispense beverages such as soft drinks, fruit juices, water, or alcohol, but not limited thereto. Typically such bag-in-box packages comprise a collapsible bag or bladder disposed within a cardboard or plastic box. The bag has a spout for filling the bag with liquid and the spout protrudes through a side wall of the box for dispensing the liquid from the bag.

One of the problems associated with such bag-in-box packaging is that the bag collapses upon itself as the liquid is withdrawn, which tends to create pockets of liquid that are isolated from the spout or tap and cannot be withdrawn from the lower portion of the bag. Another drawback with bag and box packaging or containers is that the tap or spout needs to be supported within in one of the side walls of the box and this results in an accumulation of the liquid in the area of the box below the level of the tap or spout. Thus the residual portion of liquid remaining in the bag is wasted. It is cumbersome and awkward for a user to open the nearly empty box, remove the bag and to squeeze the remaining fluid out from the box. This problem is amplified by the fact that when a bag and box container is placed inside the dispenser the residual liquid cannot be squeezed dry by a user and results in wastage of the beverage or liquid.

This results in fluid being either thrown out or being manually squeezed out of the box, after the liquid has ceased dispensing and the bag has been removed from the protective box and the box has been removed from the dispenser. For example, from tests carried out a typical 10 liter box had 1.3 liters of beverage or liquid left inside the bag by the time the dispense flow rate had turned into a trickle or almost non-existent trickle.

Numerous solutions have been disclosed to solve the above mentioned problems. European Patent Publication number EP 1 520 836, in the name of Model AG, discloses a bag-in-box dispensing apparatus in which the box is tilted at an angle to the dispensing apparatus to urge the liquid from the bag and box through a tap or spout. However this solution has been shown to be unsatisfactory.

Another solution is proposed by US Patent Publication Number US 2003/0155372, in the name of Yorn et al, discloses a bag-in-box apparatus where the interior bottom of the surface of the box is preferably sloped or terraced downwards towards the spout of the bag such that gravity helps the liquid towards the spout, as shown in FIG. 1 by the dotted lines. However it has been found that this bag-in-box apparatus still results in waste liquid forming at the base of the box. In addition the box manufacturing costs are substantially increased to accommodate a slope in the box.

Heretofore, no satisfactory solution has been proposed to overcome the above mentioned problems.

SUMMARY OF THE INVENTION

According to the present invention there is provided, as set out in the appended claims, a system for use in dispensing a liquid comprising: a container, for example a box, for housing a flexible bag, the flexible bag having a bag wall with an interior surface for storing the liquid; and a spout disposed through said bag wall for dispensing liquid from said bag; wherein the container comprises a tear-off portion positioned near the base of the container to provide an opening to allow the spout project from the container, and allow the bag to be substantially pulled out of the container, so that the spout projects substantially under the base level of said container in use.

Ideally, the tear-off portion is adapted to provide an opening at the base of the container. In another embodiment the tear-off portion is positioned in one of the sidewalls of the container and extending around to the base of the container to form part of the base of the container.

The container or box design and the tear-off section to the front and underside of the box are specifically designed to maximise the gravitational flow rate from the container. The invention protects against manual damage to the bag as it is pulled out from the box. The advantage of the present invention is that the liquid is fully dispensed without the need for additional manual force. The combined effect of the specific tear-off portion of the bag and lower level gravitational well and the lowest level tap dispense point allows the invention to work in tandem to produce an improved flow rate of liquid and eliminate the requirement to manually squeeze the remaining liquid from the bag. In this way more liquid is dispensed from the bag.

Preferably, the spout is adapted to be pulled by a user through the opening and dropped down to a dispensing position such that the spout is positioned at a level under the base of the container in use.

Suitably, the dispensing position provides a gravitational well to urge the liquid from the bag to be dispensed via said spout. It will be appreciated that the liquid flow rate is maximised through the funneling of the liquid in the bag into a lower level "gravitational well", before dispensing from the lowest level of the spout.

Suitably, the flexible bag is a collapsible bag. Ideally the container is made from cardboard.

In one embodiment the flexible bag is adapted such that when a force is applied part of the bag can be pulled through said opening to a dispensing position.

In a further embodiment a mechanism comprises means to securely hold the spout in place in a dispensing position. The tap trapping mechanism ensures that the tap is held in position to maximise the effectiveness of the combined effects of the tear-off sections of the box.

In a further embodiment there is provided a capture mechanism comprising means to securely hold the spout in place in a dispensing position. Ideally the capture mechanism is a single unit adapted to operate either in a push arrangement or a pull arrangement to dispense said liquid.

Preferably, the capture mechanism provides access to the spout after capture. Sealing means may be provided on the spout, and the capture mechanism may allow removal of the sealing means post-capture.

In another embodiment there is provided a housing adapted for storing one or more containers wherein at least one container is arranged in a dispensing position. Ideally, the housing comprises at least one stabilising leg connected to a base of said housing. Suitably, the container, arranged in the dispensing position, is arranged on a sloping floor of the housing relative to the ground.

Preferably the housing comprises a refrigeration unit. The refrigeration unit may comprise a chilling plate positioned to engage with said flexible bag to allow heat transfer to aid chilling plate to chill said liquid. Ideally the top surface of the housing comprises a tactile surface.

In will be appreciated that the system of the present invention provides a combination of specifically designed tear-off sections which allows for the safe drop-down and out of the bag, the specifically designed gravitational trapping well, the specifically designed tap capture mechanism all work in tandem to ensure a free flow of the liquid is dispensed from the bag thereby ensuring the maximum gravitational forces are brought to bear on the dispensing water to ensure the most efficient flow rate.

In a further embodiment there is provided a container, for example a box, comprising: a housing for housing a flexible bag, the flexible bag having a bag wall with an interior surface for storing the liquid; and a spout disposed through said bag wall for dispensing liquid from said bag; wherein the container comprises a tear-off portion positioned near the base of the container to provide an opening to allow the spout project from the container, and allow the bag to be substantially pulled out of the container, so that the spout projects substantially under the base level of said container in use.

BRIEF DESCRIPTION OF THE DRAWINGS

The invention will be more clearly understood from the following description of an embodiment thereof, given by way of example only, with reference to the accompanying drawings, in which:—

DETAILED DESCRIPTION OF THE DRAWINGS

Figure 1:
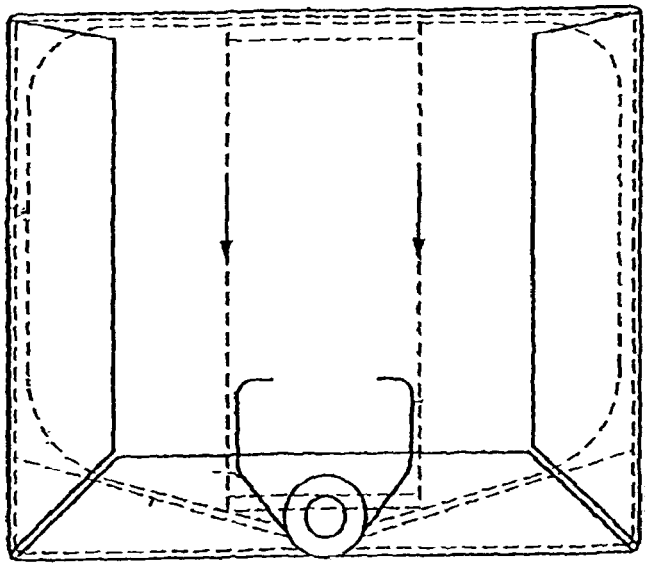
FIG. 1 shows a prior art bag-in-box.

Referring now to the drawings and specifically FIGS. 2 to 5 inclusive there is illustrated a bag-in-box according to a first aspect of the present invention.

Figure 2:
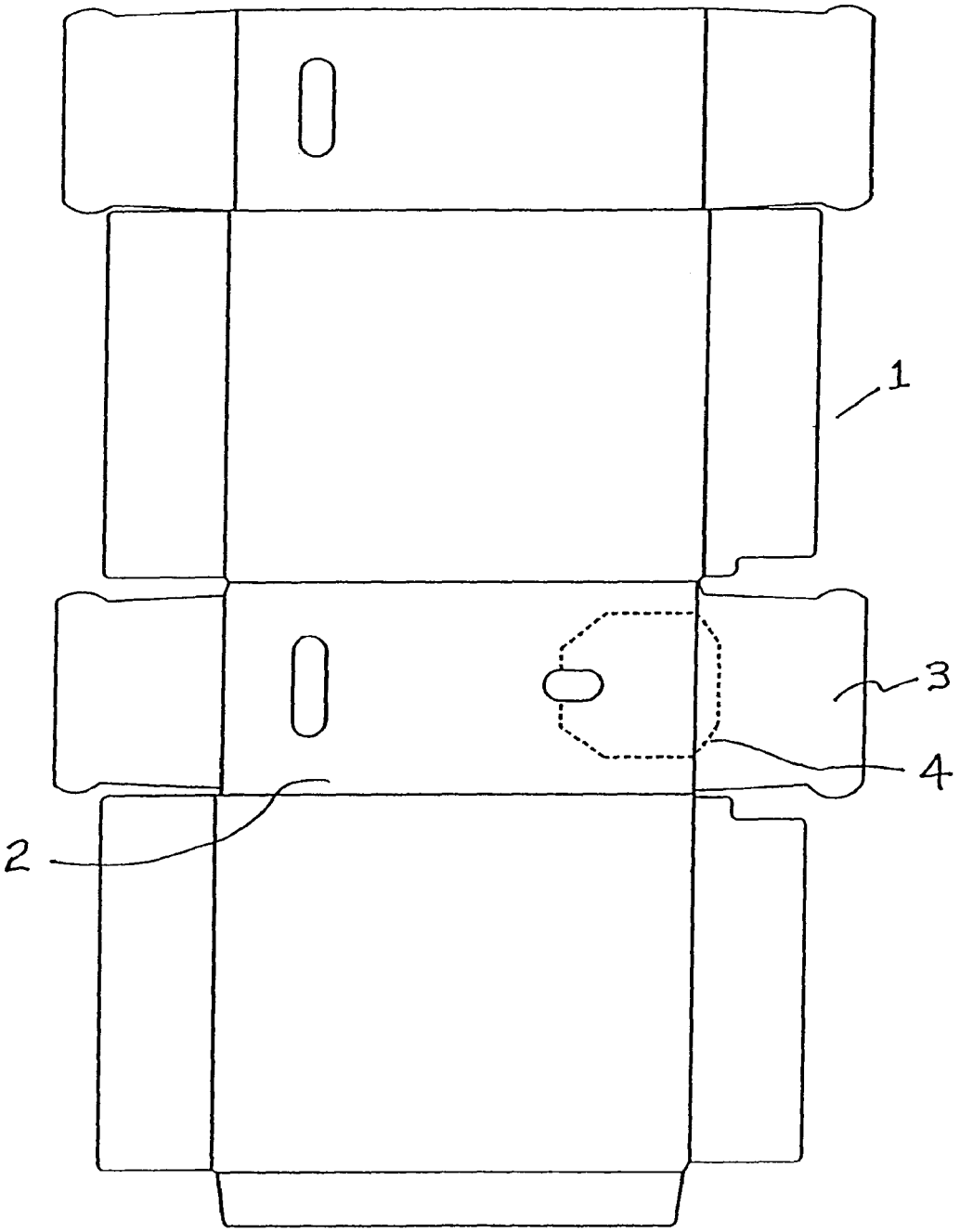
FIG. 2 illustrates a bag-in-box system according to one aspect of the invention.
Figure 3:
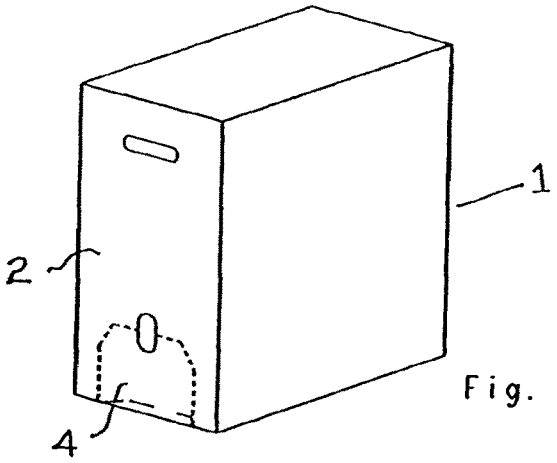
FIGS. 3-5 illustrate the bag-in-box system in use.
Figure 4:
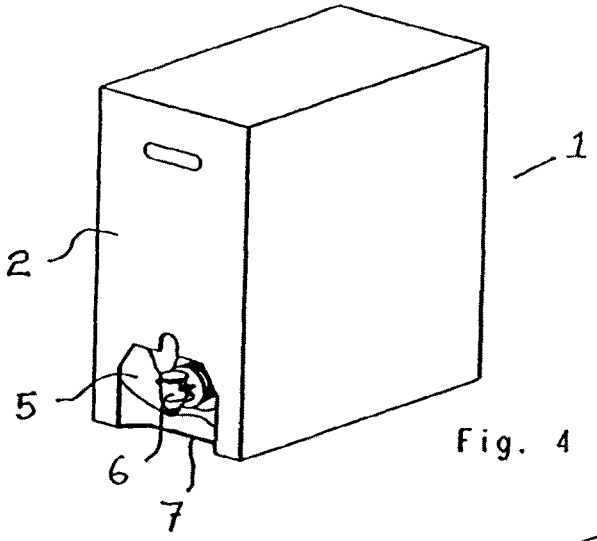
Figure 5:
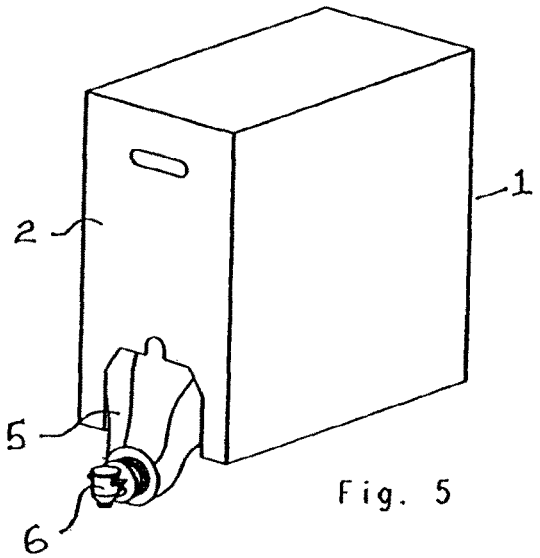
Figure 6:
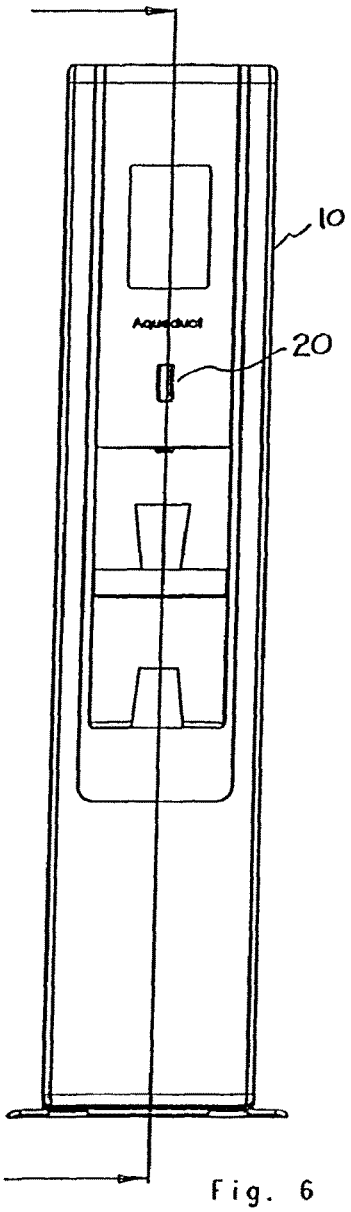
FIG. 6 is a front view of the housing for the bag-in-box system.
Figure 7:
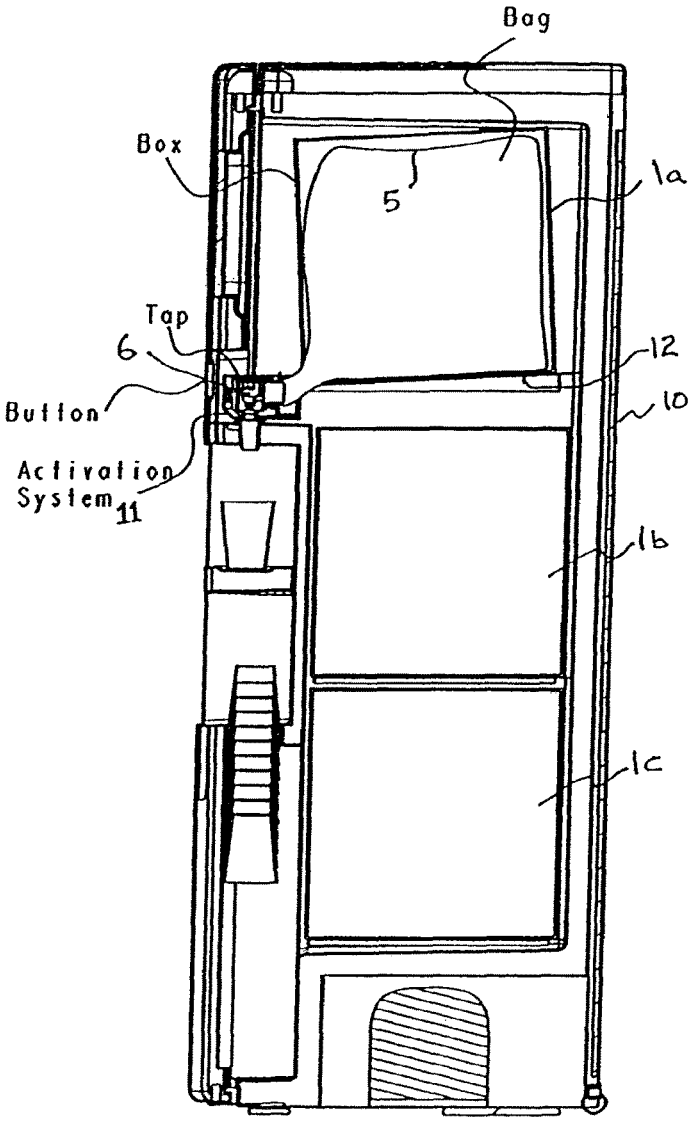
FIG. 7 is a cross sectional view of the housing.
Figure 8:
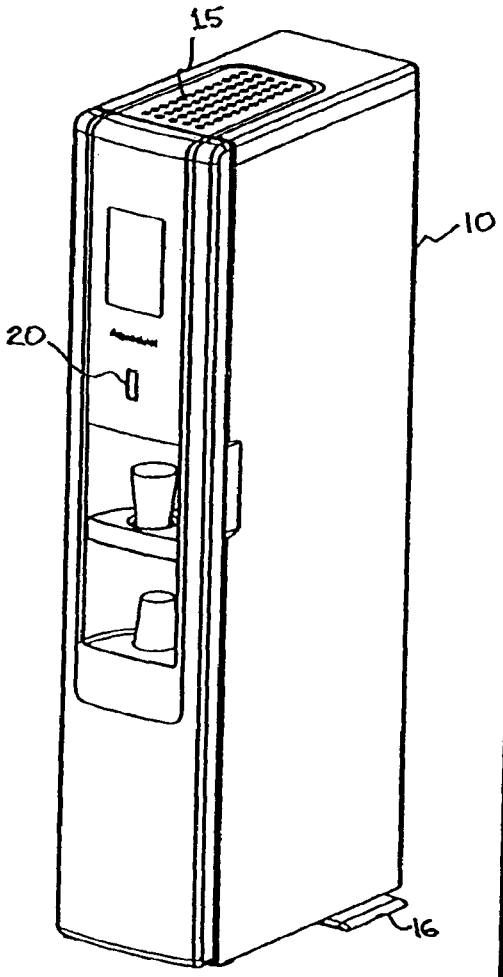
FIGS. 8 and 9 are a perspective view of the housing in an open and closed position.
Figure 9:
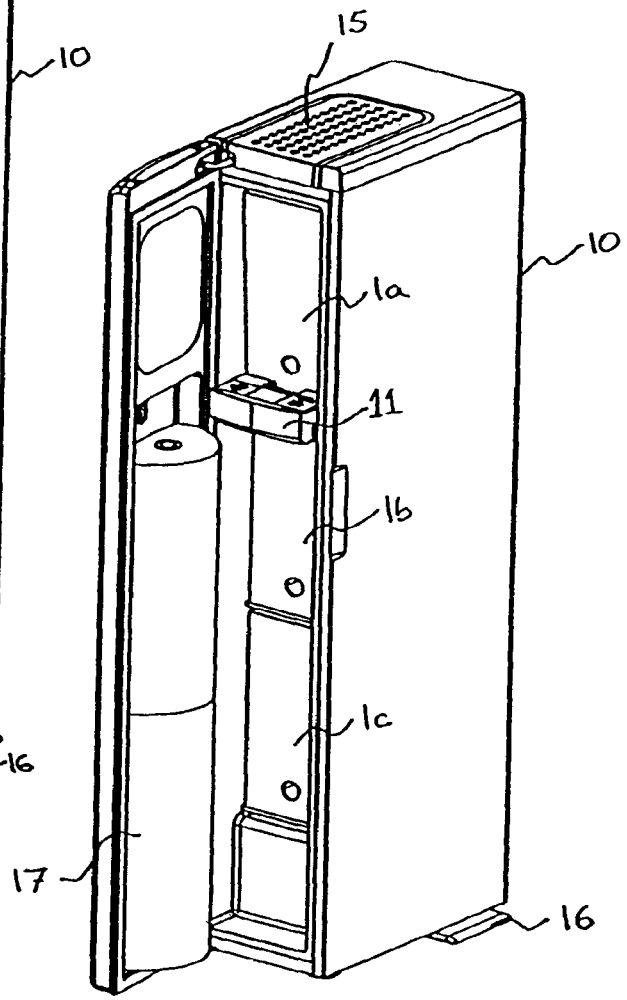

FIG. 2 shows a blank illustrated generally by the reference numeral (1) having at least one side wall (2) and a portion (3) that will form the part underside of a container. The dotted line portion (4) indicates a tear-off portion that forms part of the side wall (2) and the underside (base) portion (3). In use the blank (1) is folded to form a container, for example a box for housing a flexible bag, as shown in FIG. 3. The flexible bag has a bag wall with an interior surface for storing a liquid. FIG. 3 shows the box ready for storage or transporting to another location. The tear-off portion defined by the dotted-line (4) is provided and positioned near the base of the container. The tear-off portion can be torn off to define a large opening at the base of the side wall (2) of the container. In addition the tear-off portion (when torn off) defines a large opening on the underside base of the box. This is illustrated in FIG. 4 where the tear-off portion (4) has been removed to reveal the bag (5) inside the box (1). A spout, or tap, (6) is shown and is in communication with the bag (5) to provide an outlet for the liquid to be dispensed.

The spout (6) is adapted to be pulled by a user through the opening and dropped down in a dispensing position such that the spout (6) is positioned at a level under the base of the container (1). The effect of the tear-off portion is to provide a single opening (7) in the side wall and the base of the box to allow the spout (6) to descend easily into a dispensing position. It will be appreciated that the bag is pulled forward partially out of the box itself and dropped downwards towards the ground to form a "gravitational well" due to the opening formed by the tear-off portion being in the side wall and the base. In the descended position the spout (6) is at a level substantially under the base of the container (1). This allows for a natural gravitational flow so that the liquid is urged towards the spout (6). It has been found that this arrangement is very efficient in that most or all of the liquid in the bag will be dispensed through the spout (6) without the need for additional force.

The spout or tap is lowered past the gravitational well to sit snugly in a specifically designed tap capture mechanism holding the spout (6) in place at the lowest possible level relative to the base of the box (1). The combined effect of the specific tear-off portion of the bag and lower level gravitational well and the lowest level tap dispense point allows the invention to work in tandem to produce an improved flow rate of liquid and eliminate the requirement to manually squeeze the remaining liquid from the bag. In this way more liquid is dispensed from the bag.

Referring now to FIGS. 6 to 9, there is illustrated one embodiment of a housing according to the present invention for the bag-in-box system to allow liquid to be dispensed, generally indicated by the reference numeral (10). Figure shows a cross sectional view of the bag-in-box system working with the housing (10). The operation of the housing (10) is illustrated in more detail in FIG. 7. Three containers, 1*a*, 1*b* and 1*c* are shown in the housing (10). Two of the containers 1*b* and 1*c* are simply stored in the housing for future use. Container (1*a*) is positioned in the upper part of the housing (10). The container 1*a* is placed on a sloping floor (12) in the housing (10). The tap (6) engages a capture mechanism (11). The capture mechanism (11) comprises means to securely hold the spout (6) in place in a dispensing position.

The top of the housing comprises a tactile surface (15) designed to provide a non-slip surface for either people resting their hands on the surface or people placing a cup or bottle or other item on the top of the housing. The housing (10) comprises a pair of stabilising legs (16) positioned at the back of the housing to prevent the housing (10) from falling over when a force is applied. A refrigeration unit is provided (17) in the door of the housing (10). The refrigeration unit (17) chills the liquid stored in the bag-in-box containers.

It will be appreciated that alternative embodiments of housing may be used. The housing shown in FIGS. 6-10 is floor standing. Alternative embodiments may be sized to sit on a counter-top. The counter-top version may also be used with a separate container-storage base, to form a two-part floor standing unit.

Figure 10:
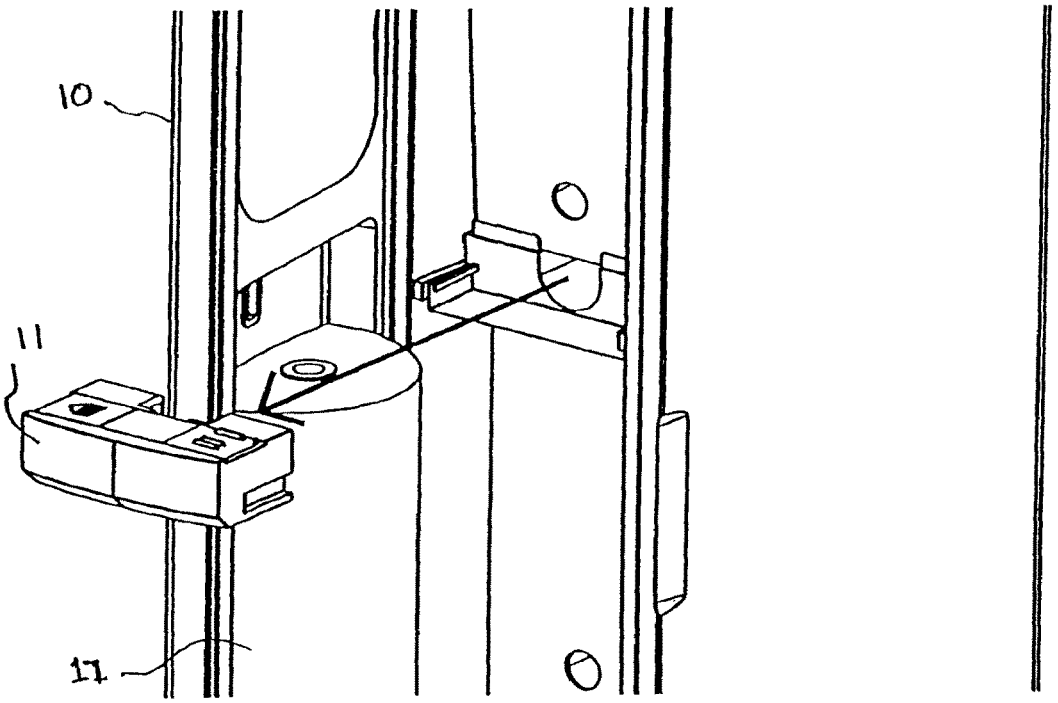
FIG. 10 illustrates a capture mechanism according to another aspect of the invention.
Figures 11, 12:
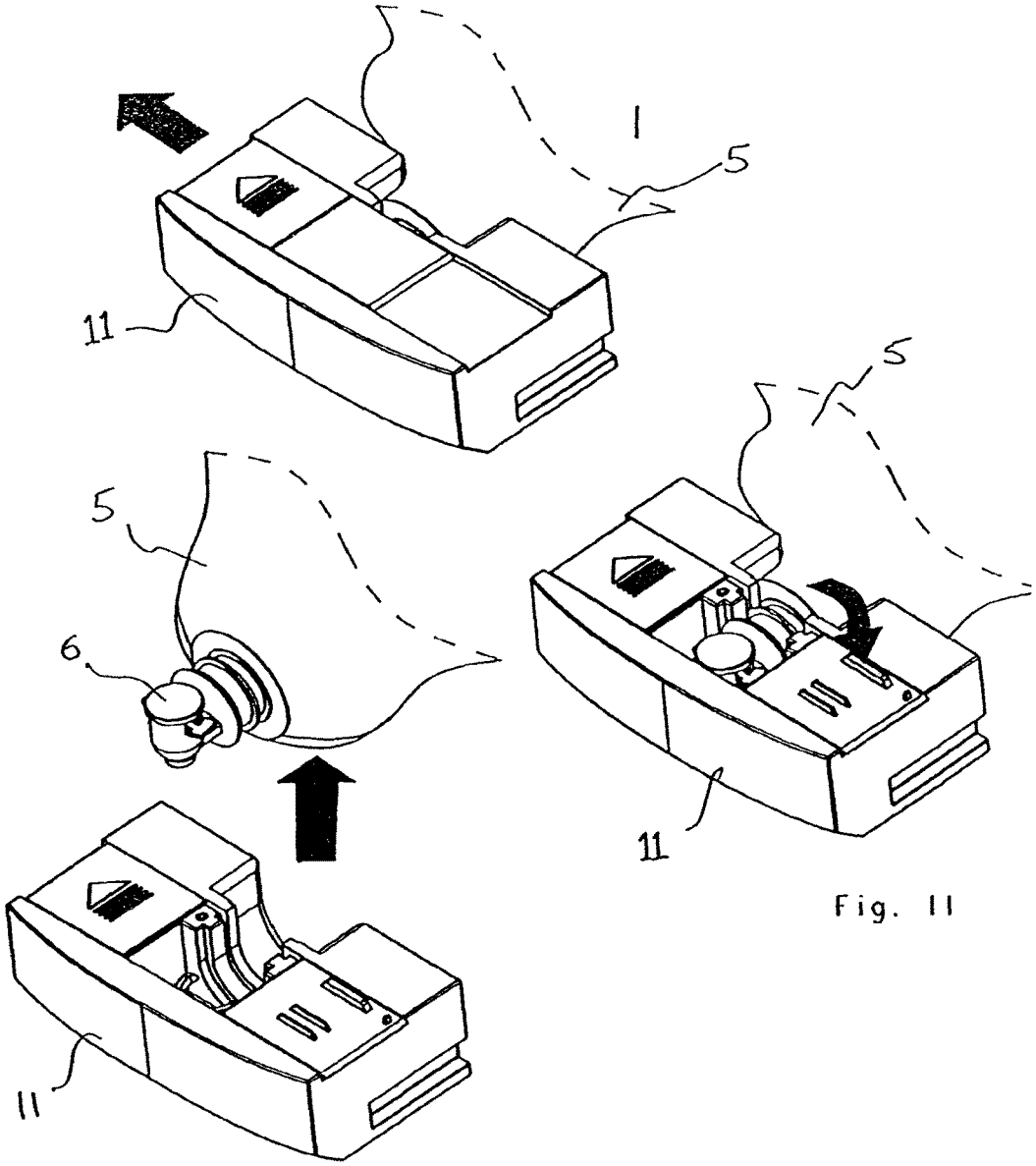
FIGS. 11 and 12 illustrates the capture mechanism of FIG. 10 in use.

Referring now to FIGS. 10 to 12 inclusive there is illustrated one embodiment of capture mechanism (11) according to the present invention to securely hold the spout (6) in place in the dispensing position. The capture mechanism (11) is in the form of a single cartridge that can be easily slotted into the housing (10). When the tear-off portion has been removed from the container, and the spout (6) in the descended position, the spout can engage the cartridge (11) in a substantially u-shaped trapping mechanism to engage with the spout or tap (6) and securely hold in place. An important aspect to the cartridge design is that it is easy to use and it is simple to have the spout (6) engage with the cartridge (11). It will be appreciated that the embodiment of capture mechanism shown in FIGS. 10 to 12 hides the spout from view. In alternative embodiments, as described later, it may be desirable not to hide the spout from view. The capture mechanism is specifically designed so that it can be activated either to operate in a push arrangement or a pull arrangement to dispense liquid from the bag.

Figure 13:
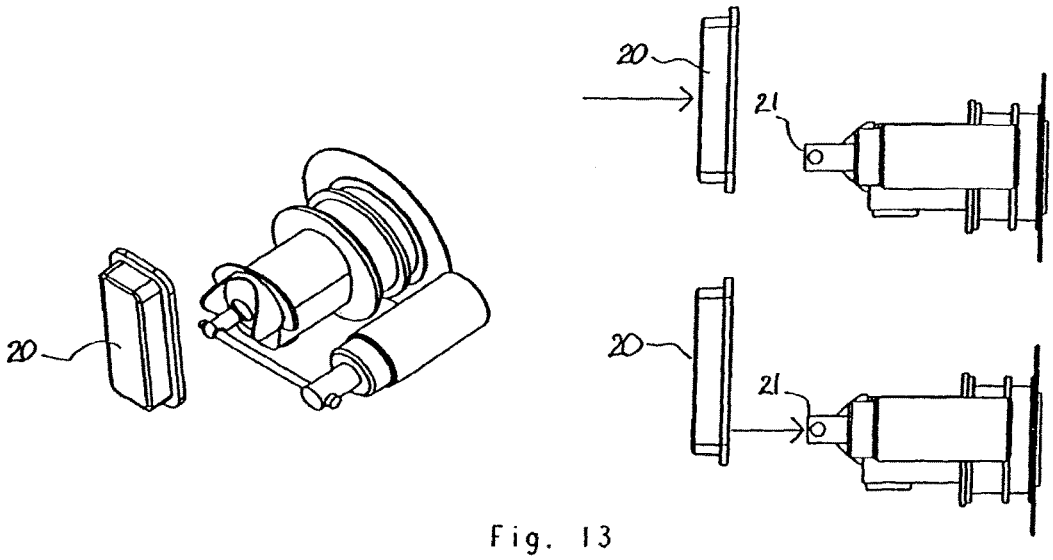
FIG. 13 is a first embodiment of the capture mechanism.
Figure 14:
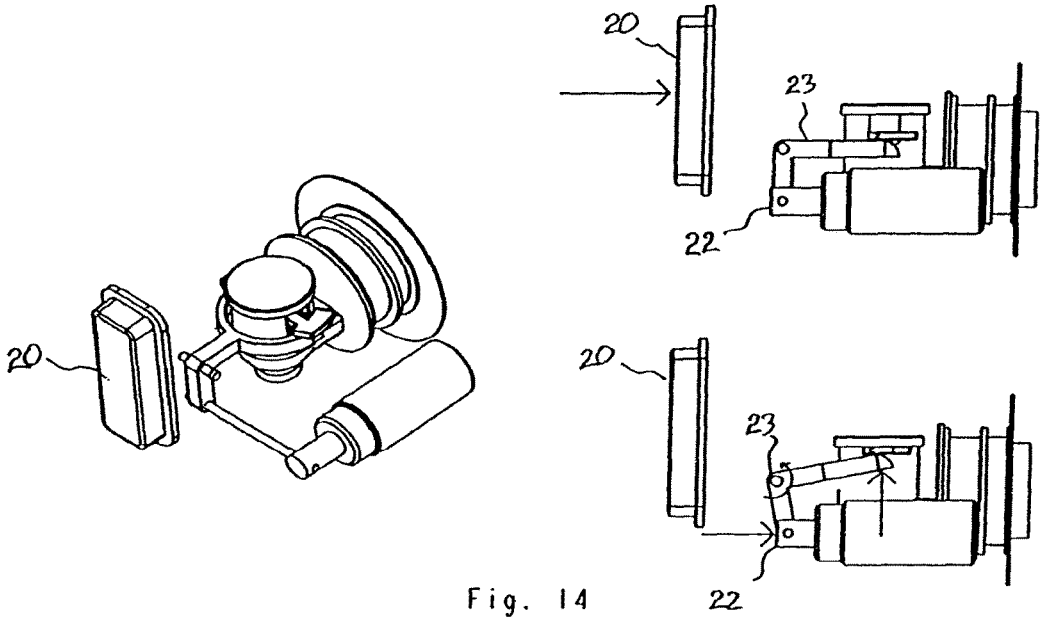
FIG. 14 is a second embodiment of the capture mechanism.

FIG. 13 illustrates how the tap can be activated by a mechanical activation system that will push in the tap (in the case of pushing taps) or as illustrated in FIG. 14 a lever up the tap (indicates of a pull up tap). These mechanisms can thus operate on the majority type of spouts available in the marketplace. By having a single capture mechanism (11) that can operate in both a push and pull up mode means that the invention can be adapted to various dispensers available in the marketplace. The tap capture mechanism can be activated to dispense liquid from the spout (6) using a button (20) located on the outside of the housing (10). The single unit comprises a solenoid mechanism to provide a direct pull in mechanism and the latter having a pull in and pivot mechanism.

As illustrated in FIG. 13 the button (20) can be depressed so that the spout (6) is engaged via actuating elements (21) in a push arrangement. In the other embodiment as illustrated in FIG. 14 the button (20) is pressed to engage an actuating element (22) and lever (23) to dispense liquid from the bag using a lever arrangement using a pivot mechanism. It will be appreciated that both actuation elements are included in a single capture mechanism unit to dispense liquid from the spout.

It will be appreciated that a manually activated tap may be employed with the bag-in-box system. A suitable capture mechanism for manual activation may be provided.

Figure 15:
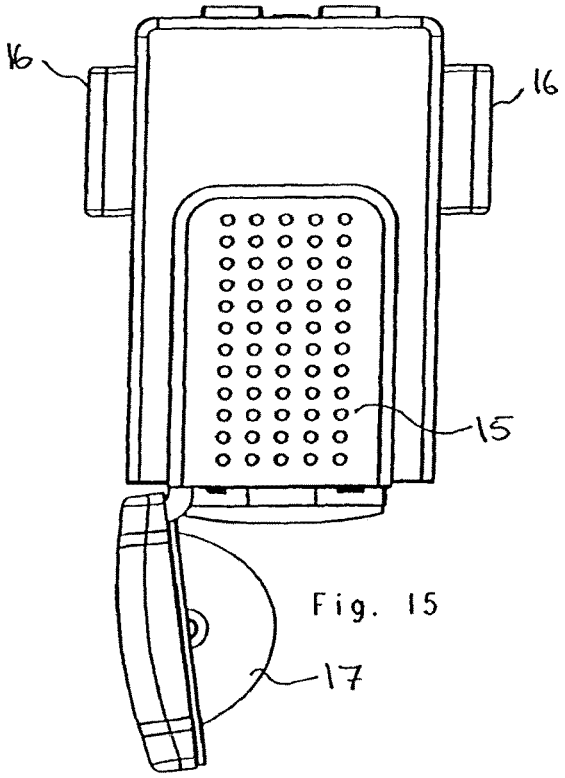
FIGS. 15 and 16 are a plan view of the top of the housing for the bag-in-box system.
Figure 16:
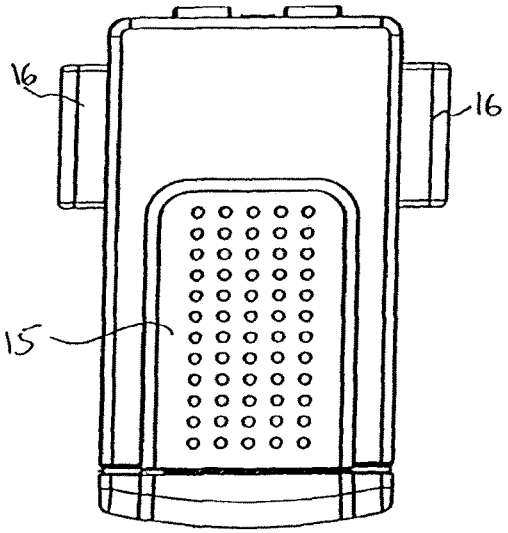

FIGS. 15 and 16 illustrate a top plan view of the housing (10) from FIGS. 6 to 9 showing the tactile surface (15) to provide a non-slip surface for the user and for objects placed on the surface (15). In addition the pair of stabilising legs are shown located at the bottom of the housing (10) to provide additional support for the housing (10).

It will be appreciated that the refrigeration unit (17) provides a chilling plate to engage with the surface of the container or the liquid bag to engage with the flexible bag to allow the heat transfer to chill the bag.

In a further embodiment of the present invention the tear-off portion can essentially have two tear-off steps. Tear-off portion allows the bag and tap to either to be pulled substantially out of and down from the box or which by only tearing a portion of the box allows for the tap to be pulled out and slid against the main wall of the box. The tear-off flap remains attached to the container and can be pushed back in place resulting in the tap being held in place by the walls of the box and the replacement flap below.

Figure 17:
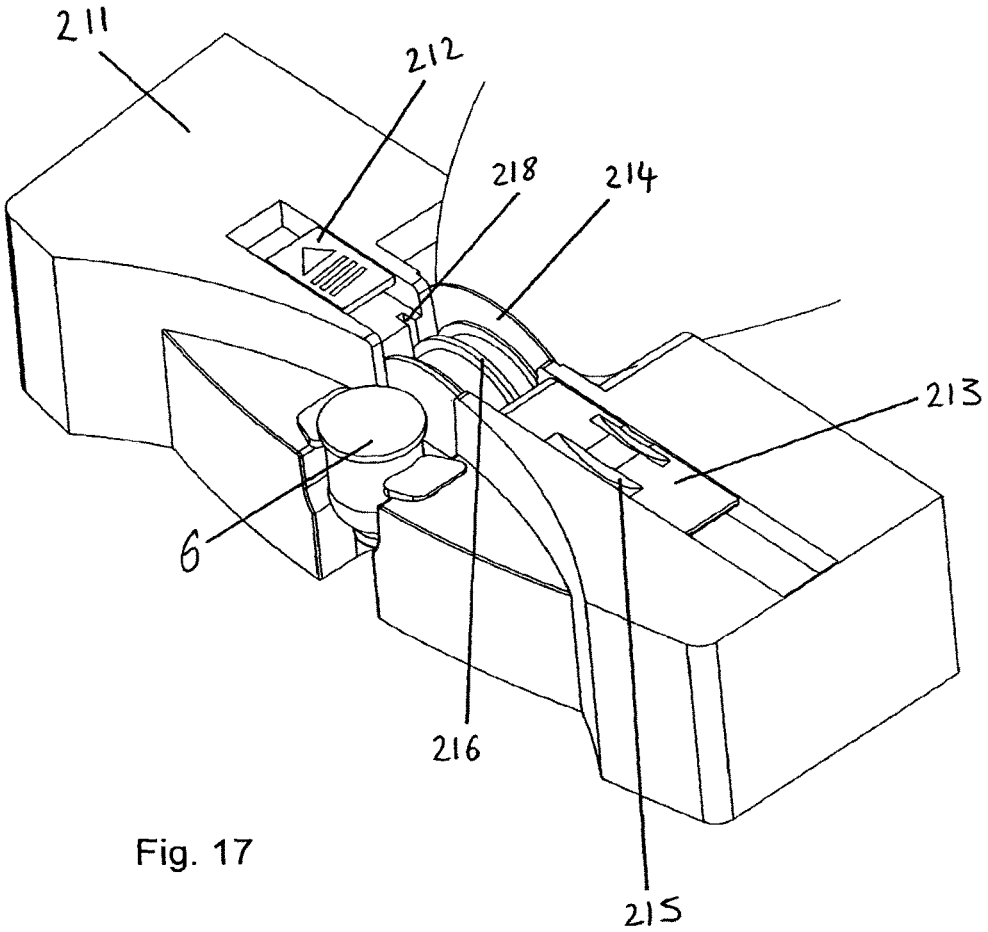
FIG. 17 is an alternative embodiment of capture mechanism according to the present invention, shown in an unlocked position.
Figure 18:
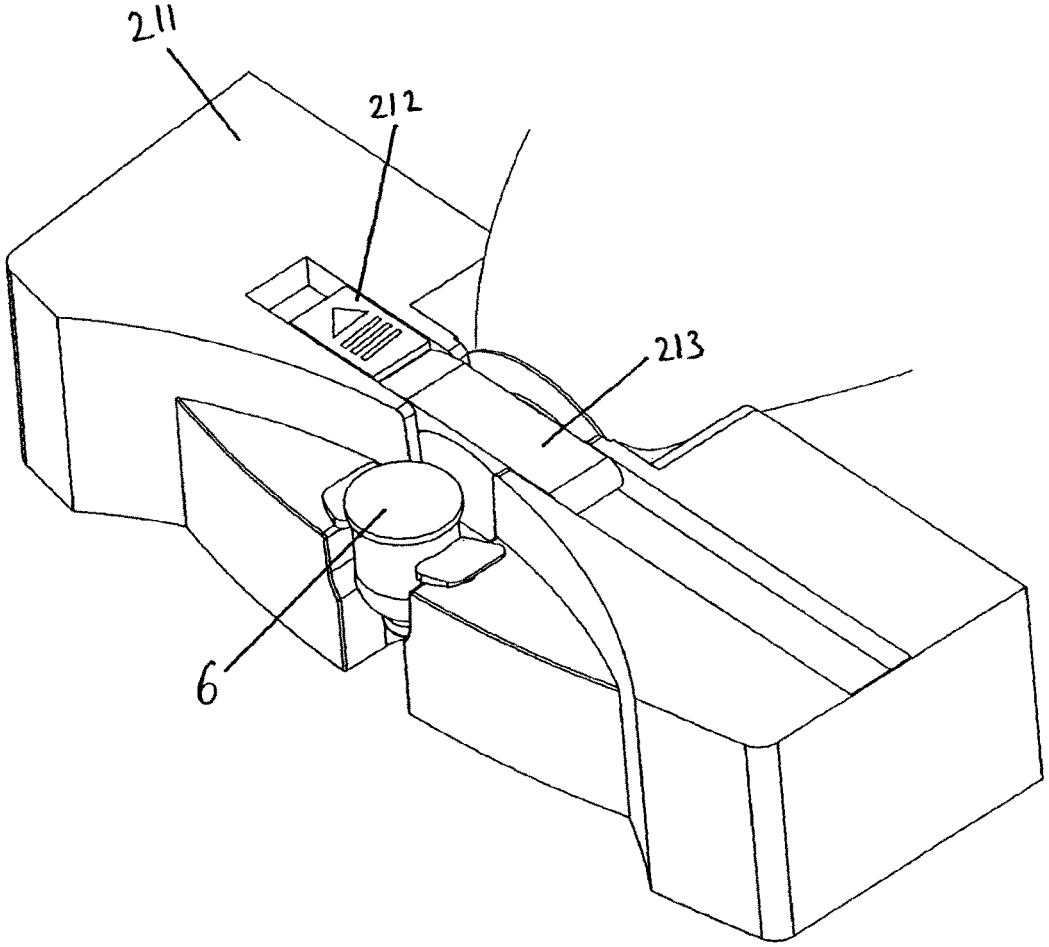
FIG. 18 is the capture mechanism of FIG. 17 shown in a locked position.

FIGS. 17 and 18 show an alternative embodiment of capture mechanism according to the present invention. In this embodiment, the spout (6) is accessible, and not hidden from view.

The capture mechanism (211) functions similar to that shown in FIGS. 11 and 12 in that it securely holds the spout (6) in place in the dispensing position. The capture mechanism (211) is in the form of a single cartridge that can be easily slotted into any embodiment of housing. When the tear-off portion has been removed from the container, and the spout (6) in the descended position, the spout can engage the cartridge (211) in a substantially u-shaped trapping mechanism to engage with the spout or tap (6) and securely hold it in place.

A tap/flange locking bar (213) is provided to lock the tap in position. The bar (213) pivots between an open and closed position over the neck of the spout. As seen in FIG. 17 the underside of bar (213) is provided with recesses (215) to cooperate with the protruding rings (216) around the tap flange (214). These aid in retaining the tap securely within the capture mechanism. As seen in FIG. 17, similar recesses (218) are provided in the u-shaped recess in the body of the capture mechanism. A sliding lock (212) is also provided to lock the locking bar in position.

Alternative capturing features may be provided in alternative embodiments of capture mechanisms. It will be appreciated that different sized and shaped taps and flanges will require different internal arrangements within the capture mechanism.

An advantage with the embodiment of capture mechanism shown in FIGS. 17 and 18 is that the tap is accessible even after being captured. The tap may be comprise sealing means, such as a tamper proof seal or strip, not only for hygiene reasons, but primarily to prevent accidental or unauthorised activation of the tap prior to installation in the housing. It will be appreciated that the sealing means must therefore be removed prior to use. It is desirable however to leave the sealing means in place even after the tap is captured in the mechanism. The present embodiment of capture mechanism allows the sealing means to remain in place until immediately prior to use, after the bag-in-box system has been fully installed in the housing. The arrangement of the capture mechanism permits removal of the sealing means at the very last moment prior to use, rather than prior to, during or immediately after insertion into the capture mechanism.

It will be appreciated the invention is very suitable to dispensing water or other types of liquids in a hygienic and efficient manner. In addition bottles for dispensing water are heavy and can be difficult to refill to the user with the possibility of causing back injury for the user. The housing (10), in the form of a water cooler/dispenser, of the present invention makes it easy to store and empty containers.

It is envisaged that the present invention will provide 15 liter units of water per container. It will be appreciated that the empty containers use far less space than packaging and can be easily collapsed as opposed to empty bottles that have to be collected and are bulky to transport back to a site for refilling. It has been found that bottled water uses very poor storage facility. For example for every 9 bottles stored there is space for 4 bottles used up due to the circular shape of the bottles. It will be appreciated that the bag-in-box system of the present invention is much more efficient to store and to transport when compared to bottled water. There are obvious cost advantages and environment advantages in using the bag-in-box system according to the present invention for use in dispensing water. It will be appreciated that the housing of the present invention used for dispensing water can include an LCD screen on the outside of the housing for graphics marketing or branding the product.

It will be appreciated that the container can be made from cardboard or any other suitable type of material. The flexible bag to store the liquid can be made of any suitable type of plastics material. It will be appreciated that the spout that is integrally formed with the flexible bag can be designed such that the portion around the spout is adapted to be pulled down under the level of the box to form the gravitational well. In the context of the present invention the term spout is to be used interchangeably with the term tap. Furthermore the term container and box are to be used interchangeably and are to be afforded the widest possible interpretation in the context of bag-in-box systems. The term liquid should also be interpreted broadly when interpreting applications of the invention.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention is not limited to the embodiments hereinbefore described but may be varied in both construction and detail.

The invention claimed is:

1. A beverage dispensing system comprising:

a flexible bag housed in a container;

the flexible bag having a bag wall with an interior surface for storing the beverage, and a spout disposed through said bag wall, the spout comprising a valve;

the container comprising a tear-off portion positioned near the base of the container to enable a portion of the sidewall and a portion of the base to be removed, the tear-off portion being large enough to allow the spout and a portion of the bag surrounding the spout to drop out of the container substantially through the sidewall when the tear-off portion is removed; and a capture mechanism adapted to securely hold the spout in a dispensing position forward of the sidewall of the container and substantially lower than the base of said container so that a portion of the bag around the spout forms a gravitational well at a lower level than the base of the container when the spout is captured, wherein the spout engages the capture mechanism via at least one actuating element in a push or pull arrangement, and wherein the system allows gravitational outflow of a beverage when the valve is in an open position.

2. The system of claim 1 wherein the flexible bag is a collapsible bag.

3. The system of claim 1 wherein the container is made from cardboard.

4. The system of claim 1 wherein the capture mechanism is a single unit adapted to operate either in a push arrangement or a pull arrangement to dispense said beverage.

5. The system of claim 1 further comprising:

a housing adapted for storing one or more containers wherein at least one container is arranged in a dispensing position.

6. The system of claim 5, wherein the housing comprises at least one stabilizing leg connected to a base of said housing.

7. The system of claim 5 or 6, wherein the container arranged in the dispensing position is arranged on a sloping floor of the housing relative to the ground.

8. The system of any of claims 5 to 7, wherein said housing comprises a refrigeration unit.

9. The system of claim 8, wherein said refrigeration unit comprises a chilling plate positioned to engage with said flexible bag to allow heat transfer to said chilling plate to chill said beverage.

10. The system of any of claims 5 to 9, wherein the top of the housing comprises a tactile surface.

* * * * *